US006817352B1

(12) United States Patent
Saunders

(10) Patent No.: US 6,817,352 B1
(45) Date of Patent: Nov. 16, 2004

(54) DYNAMIC STABILIZER

(76) Inventor: Charles A. Saunders, 8380 36th Ave., Columbus, NE (US) 68601

( * ) Notice: Subject to any disclaimer, the term of this patent is extended or adjusted under 35 U.S.C. 154(b) by 0 days.

(21) Appl. No.: 10/350,693

(22) Filed: Jan. 24, 2003

Related U.S. Application Data

(60) Provisional application No. 60/351,392, filed on Jan. 24, 2002.

(51) Int. Cl.[7] ..... F41B 5/20

(52) U.S. Cl. ..... 124/89; 267/136; 188/378

(58) Field of Search ..... 124/89; 267/141.1, 267/136; D22/107; 188/378

(56) References Cited

U.S. PATENT DOCUMENTS

| | | | | | |
|---|---|---|---|---|---|
| 4,615,327 | A | * | 10/1986 | Saunders | 124/89 |
| 5,339,793 | A | * | 8/1994 | Findley | 124/89 |
| 5,513,622 | A | * | 5/1996 | Musacchia, Sr. | 124/89 |
| 5,975,070 | A | * | 11/1999 | Sands | 124/89 |
| 6,021,770 | A | * | 2/2000 | Sodaro | 124/89 |
| 6,186,135 | B1 | * | 2/2001 | Harwath et al. | 124/89 |
| 6,298,842 | B1 | * | 10/2001 | Sims | 124/89 |
| 6,588,414 | B2 | * | 7/2003 | McMillan, III | 124/89 |
| 2001/0025636 | A1 | * | 10/2001 | Harwath et al. | 124/89 |

* cited by examiner

*Primary Examiner*—Derris H. Banks
*Assistant Examiner*—Urszula M Cegielnik

(74) *Attorney, Agent, or Firm*—Kegan & Kegan, Ltd.; Marc E. Fineman

(57) ABSTRACT

A dynamic stabilizer comprising an elastomerically cushioned weight coaxially and movably mounted on an elastomerically cushioned support rod. In the preferred embodiment, the stabilizer includes a support rod, end caps, a vibration-absorbing mechanism, and a weight. The support rod is a generally cylindrical, elongated rigid member. The end caps are removably attached to each end of the support rod along the longitudinal central axis of the support rod. A threaded shaft, coaxial with the longitudinal central axis of the support rod, projects from the free end of one end cap to permit the stabilizer to removably attach to a threaded aperture in the forward face of a bow, or to a threaded aperture in a shock dampener or other archery bow accessory. The free end of the other end cap includes a threaded aperture, also coaxial with the longitudinal central axis of the support rod, to permit the removable attachment of other bow accessories to the stabilizer. The vibration-absorbing mechanism includes an elongated elastomeric tubular member that extends around and cushions the support rod, as well as a plurality of elastomeric cushioning rings that adjoin the weight coaxially on the support rod. The weight, coaxially rides along the elastomerically cushioned support rod between the elastomeric cushioning rings and the end caps. In other embodiments of the invention, the support rod may be lengthened and additional weights and cushioning rings may be added to achieve the desired stabilization effect. Additionally, the weights may be made adjustable by incorporating a means to add and/or remove ballast as necessary to achieve the desired stabilization effect.

15 Claims, 8 Drawing Sheets

DYNAMIC STABILIZER

CROSS-REFERENCE TO RELATED APPLICATIONS

This application claims the benefit of U.S. Provisional Application No. 60/351,392, filed Jan. 24, 2002.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates generally to archery bows, and more particularly to an improved dynamic stabilizer for reducing vibration and torque of the bow during launch of an arrow.

(2) Description of the Prior Art

Stabilizers and shock absorbers for archery bows have been utilized in the archery field for many years. Bows without such systems are affected by the shock and vibrations that occur during the launch and release of an arrow from the bow. Because the trajectory of the arrow is affected by any movement or vibration of the bow during the arrow's launch, it is desirable to reduce and/or eliminate such shock, vibrations, and torque to the greatest extent possible.

Various types of stabilizers have been developed for archery bows. Many prior art stabilizers involve adding a cantilevered weight to the bow to increase the bow's stability by increasing the bow's inertial capacity. Many stabilizers are mounted forward of the bow with a means allowing relative movement between the weight and the bow along with a means to restore the stabilizer to its original position, such as a spring. Examples of various prior art stabilizers include spring-loaded stabilizers, fixed mass stabilizers, movable fluid stabilizers, and parallel rod stabilizers. In many cases, such stabilizers are adjustable by extending their length or adding weight to accommodate various conditions, archers, draw weights, and the like. However, all of these stabilizers have limited stabilizing effectiveness.

BRIEF SUMMARY OF THE INVENTION

The stabilizer of the present invention comprises an elastomerically cushioned weight coaxially and movably mounted on an elastomerically cushioned support rod. In the preferred embodiment, the stabilizer includes a support rod, end caps, a vibration-absorbing mechanism, and a weight. The support rod is a generally cylindrical, elongated rigid member. The end caps are removably attached to each end of the support rod along the longitudinal central axis of the support rod. A threaded shaft, coaxial with the longitudinal central axis of the support rod, projects from the free end of one end cap to permit the stabilizer to removably attach to a threaded aperture in the forward face of a bow, or to a threaded aperture in a shock dampener or other archery bow accessory. The free end of the other end cap includes a threaded aperture, also coaxial with the longitudinal central axis of the support rod, to permit the removable attachment of other bow accessories to the stabilizer. The vibration-absorbing mechanism includes an elongated elastomeric tubular member that extends around and cushions the support rod, as well as a plurality of elastomeric cushioning rings that adjoin the weight coaxially on the support rod. The weight, generally cylindrical in shape, coaxially rides along the elastomerically cushioned support rod between the elastomeric cushioning rings and the end caps. In other embodiments of the present invention, the support rod may be lengthened and additional weights and cushioning rings may be added to achieve the desired stabilization effect. Additionally, the weights may be made adjustable by incorporating a means to add and/or remove ballast as necessary to achieve the desired stabilization effect.

The objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
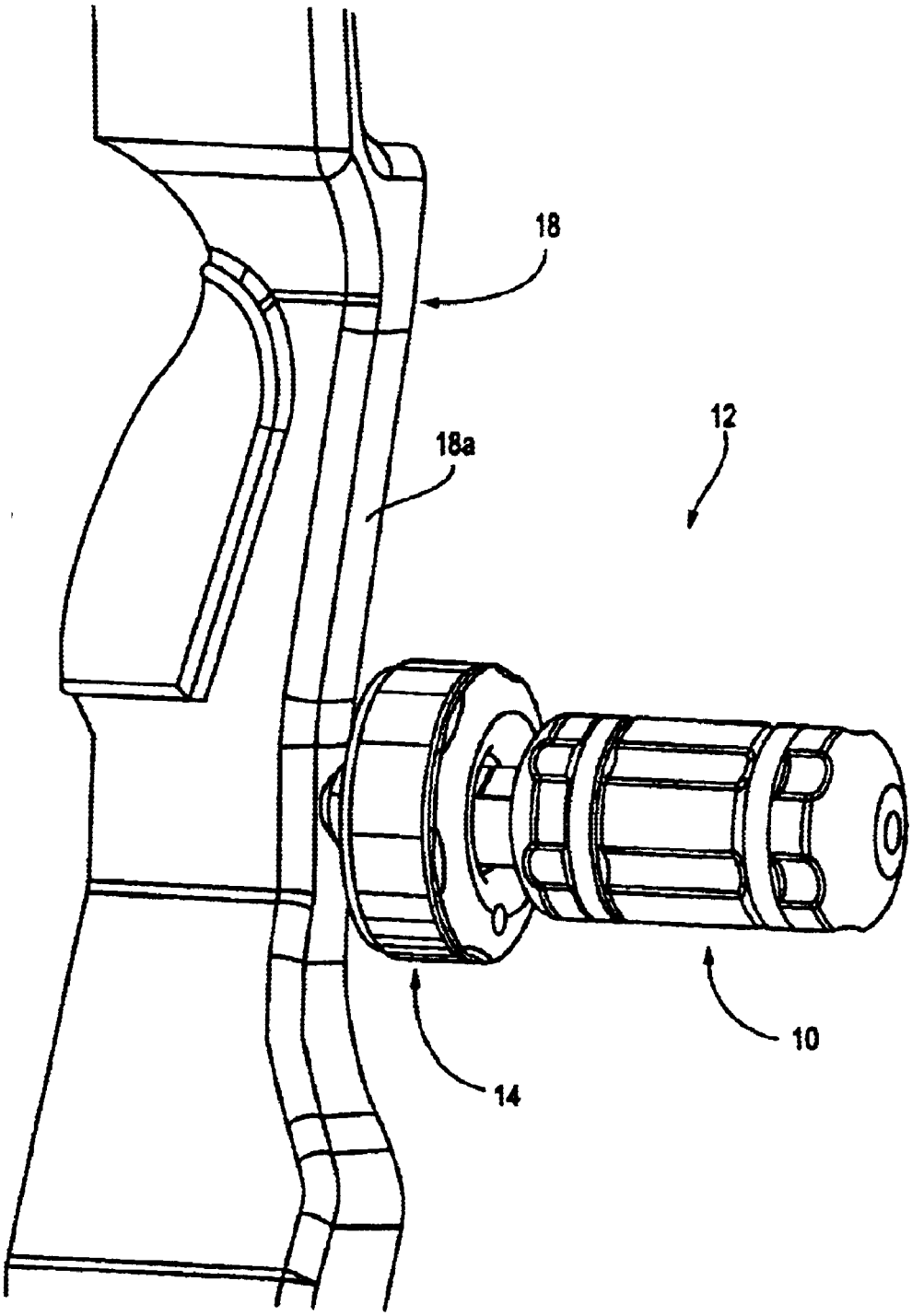
FIG. 1 is a perspective view of the preferred embodiment of the dynamic stabilizer of the present invention installed as one component of an integrated shock dampening and stabilizing system attached to an archery bow.

Referring now the drawings, in which similar or corresponding parts are identified with the same reference numeral, and more particularly to FIG. 1, the preferred embodiment of the dynamic stabilizer of the present invention is designated generally at 10 and is shown as a component of an integrated shock dampening and stabilization system 12 that also includes a shock dampener 14 mounted to a forward face 18*a* of a bow 18.

Figure 2:
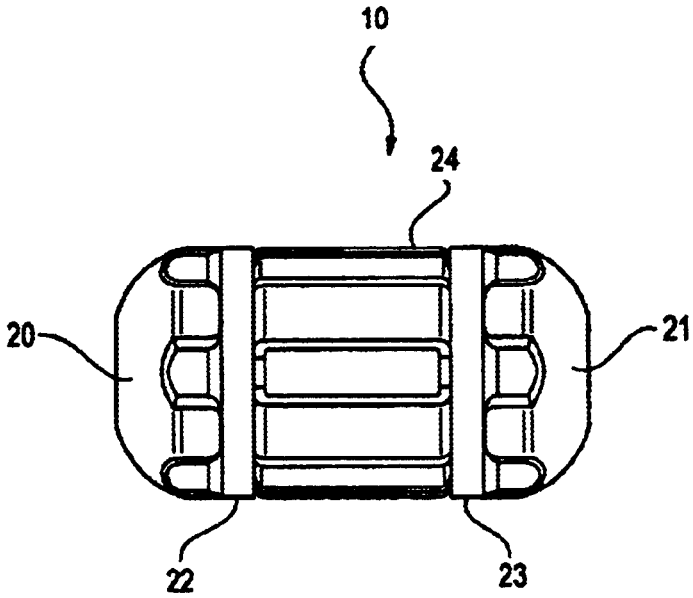
FIG. 2 is a side view of the preferred embodiment of the dynamic stabilizer of the present invention.
Figure 3:
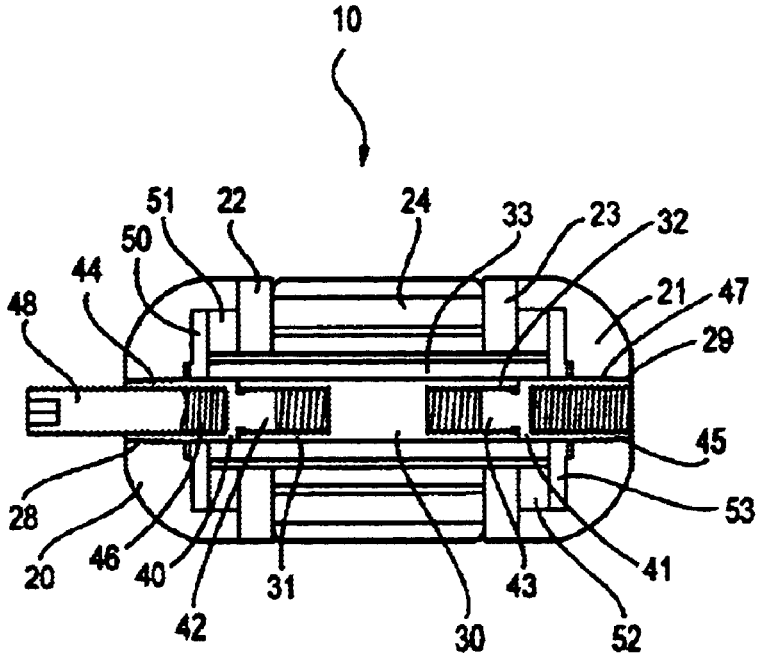
FIG. 3 is a cross sectional side view of the preferred embodiment of the dynamic stabilizer of the present invention.

Referring now to FIG. 2, an external side view of the preferred embodiment of the dynamic stabilizer 10 of the present invention, shows first end cap, second end cap 2l, first cushioning ring 22, second cushioning ring 23, and weight 24. As shown in more detail in FIGS. 3 and 4, dynamic stabilizer 10 includes support rod 30, cushioning sleeve 33, first coupler 40, second coupler 41, first end cap 20, second end cap 21, threaded shaft 48, first cushioning ring 22, second cushioning ring 23, supplemental cushioning rings 50, 51, 52, and 53, and weight 24.

Support rod 30 is a generally cylindrical, elongated, solid, rigid member having threaded apertures 31 and 32 disposed along the central longitudinal axis of support rod 30 at both ends of support rod 30. Cushioning sleeve 33, preferably constructed of an elastomeric material, such as a visco-elastic polymer, has an inner diameter slightly greater than the outer diameter of support rod 30 and extends coaxially around, and in contact with, the entire outer circumference of support rod 30. Weight 24, preferably a rigid, generally cylindrical body that extends coaxially around cushioning sleeve 33, has an inner diameter slightly greater than the outer diameter of cushioning sleeve 33, such that weight 24 is able to slide along the longitudinal axis of support rod 30. Also disposed coaxially around support rod 30 and cushioning sleeve 33, with weight 24 sandwiched between them, are first cushioning ring 22 and second cushioning ring 23. First cushioning ring 22 and second cushioning ring 23 are generally cylindrical members with the same outer and inner diameters as weight 24 and preferably are composed of the same elastomeric material as cushioning sleeve 33.

First end cap 20 and second end cap 21 are identical members, preferably rigid, and preferably with the same outer diameter as first cushioning ring 22, second cushioning ring 23, and weight 24. First end cap 20 and second end cap 21 are each formed with a threaded aperture, 28 and 29, respectively, along the central longitudinal axis of support rod 30. First coupler 40 and second coupler 41 also are identical members, preferably rigid, and are each comprised of a smaller diameter threaded stem, 42 and 43, respectively, and a larger diameter threaded stem, 44 and 45 respectively, extending along the central longitudinal axis of support rod 30. Smaller diameter threaded stems 42 and 43 have a diameter slightly less than the inner diameters of supplemental cushioning rings 50, 51, 52, and 53, first cushioning ring 22, and second cushioning ring 23, such that supplemental cushioning rings 50, 51, 52, and 53, first cushioning ring 22, and second cushioning ring 23 may slidably mount thereon. Larger diameter threaded stems 44 and 45 each include threaded apertures, 46 and 47, respectively, also extending along the central longitudinal axis of support rod 30.

When assembled in its operational form, first end cap 20 is threadably mounted to larger diameter threaded stem 44 of first coupler 40. Supplemental cushioning rings 50 and 51, and first cushioning ring 22, are slidably mounted on smaller diameter threaded stem 42 of first coupler 40. Smaller diameter threaded stem 42 of first coupler 40 is threadably mounted to threaded aperture 31 of support rod 30. As discussed above, support rod 30 is coaxially surrounded by cushioning sleeve 33. Weight 24 is then slidably mounted on support rod 30 surrounded by cushioning sleeve 33. Second cushioning ring 23 and supplemental cushioning rings 52 and 53 are then slidably mounted on smaller diameter threaded stem 43 of second coupler 41. Smaller diameter threaded stem 43 of second coupler 41 is then threadably mounted to threaded aperture 32 of support rod 30. Second end cap 21 is then threadably mounted to larger diameter threaded stem 45 of second coupler 41. Finally, threaded shaft 48 may be threadably mounted in threaded aperture 46 of larger diameter threaded stem 44. Threaded shaft 48 may then be used to removably attach the dynamic stabilizer to a threaded aperture in the forward face of a bow, or to a threaded aperture in a shock dampener or other archery bow accessory. Similarly, threaded aperture 47 of larger diameter threaded stem 45 is adapted to permit the removable attachment of other bow accessories to the stabilizer.

In operation, energy in the form of shocks, vibrations, and torque in a bow that occur during the release of an arrow are transferred through shaft 48 to elastomerically cushioned support rod 30 and weight 24, where they are converted to heat and dissipated.

Figure 4:
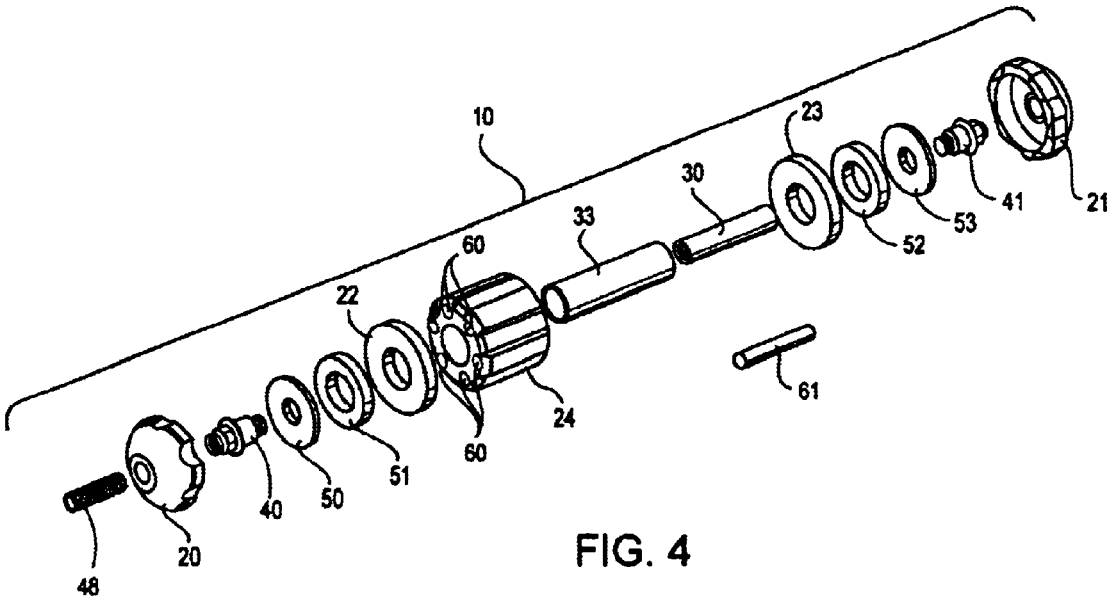
FIG. 4 is an exploded view of the preferred embodiment of the dynamic stabilizer of the present invention with the optional adjustable weight means.
Figure 5:
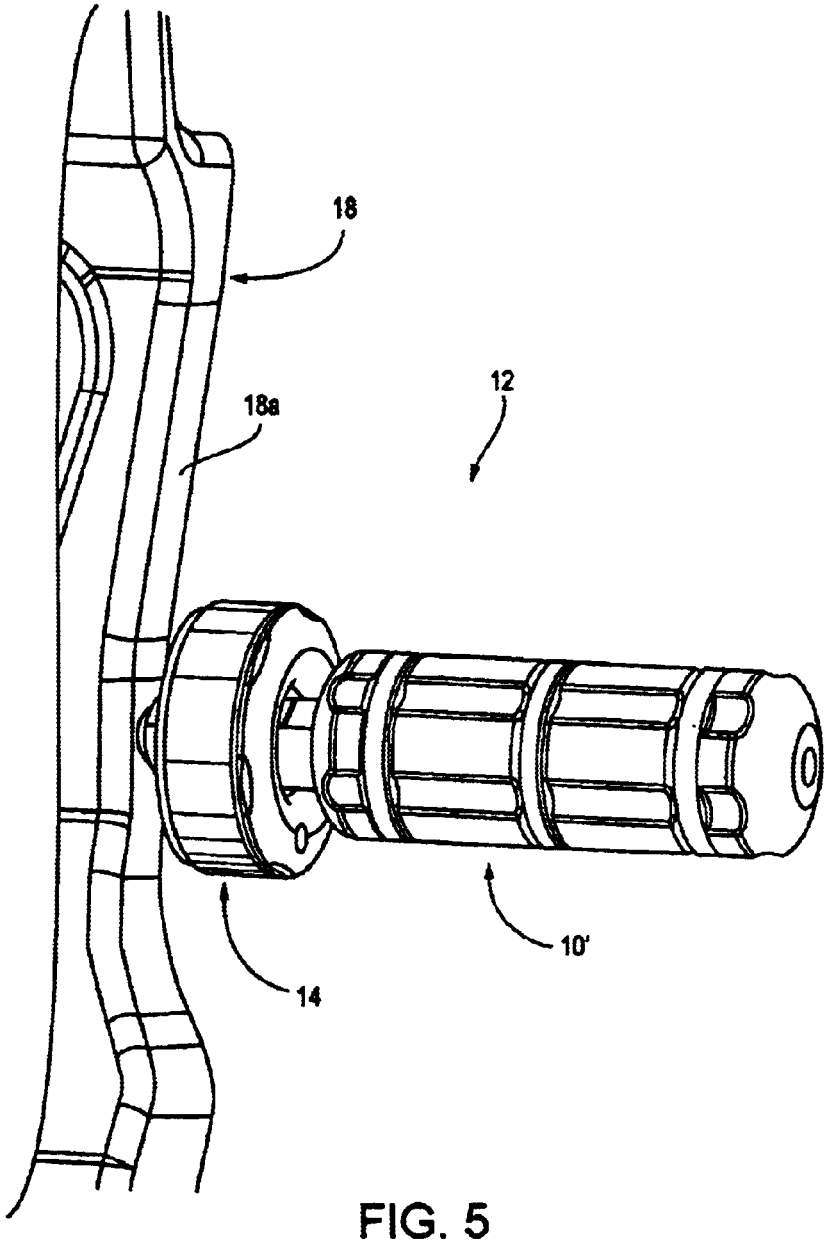
FIG. 5 is a perspective view of an alternate embodiment of the dynamic stabilizer of the present invention installed as one component of an integrated shock dampening and stabilizing system attached to an archery bow.

The preferred embodiment of the dynamic stabilizer of the present invention may optionally include a means to variably adjust the weight of weight 24. As shown in FIG. 4, weight 24 may be designed with a number of axial bores 60 around its circumference. Ballast 61 may be inserted into the axial bores 60 to achieve the desired stabilization effect.

In a second embodiment of the dynamic stabilizer of the present invention, as shown in FIGS. 5, 6, 7, and 8, the dynamic stabilizer is identical in nearly all respects to the dynamic stabilizer of the preferred embodiment, with the exception that support rod is lengthened and a second weight is added with an additional cushioning ring to provide enhanced stabilization. As shown FIG. 5, the second embodiment of the dynamic stabilizer of the present invention is designated generally at 10' and is shown as a component of an integrated shock dampening and stabilization system 12 that also includes a shock dampener 14 mounted to a forward face 18*a* of a bow 18.

Figure 6:
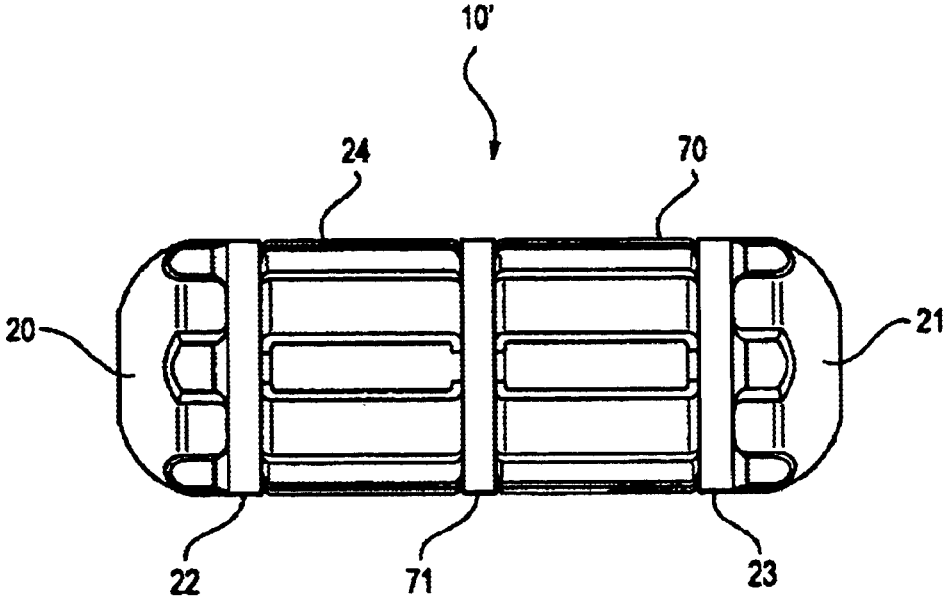
FIG. 6 is a side view of an alternate embodiment of the dynamic stabilizer of the present invention.
Figure 7:
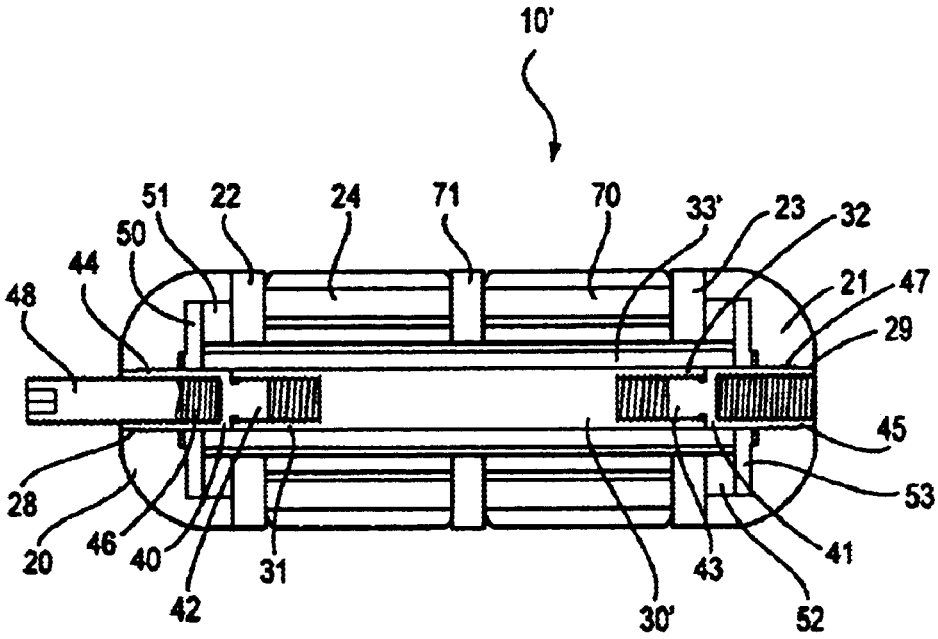
FIG. 7 is a cross sectional side view of an alternate embodiment of the dynamic stabilizer of the present invention.

Referring now to FIG. 6, an external side view of the second embodiment of the dynamic stabilizer of the present invention, shows first end cap 20, second end cap 21, first cushioning ring 22, second cushioning ring 23, weight 24, second weight 70, and third cushioning ring 71. As shown in more detail in FIGS. 7 and 8, dynamic stabilizer 10' includes elongated support rod 30', elongated cushioning sleeve 33', first coupler 40, second coupler 41, first end cap 20, second end cap 21, threaded shaft 48, first cushioning ring 22, second cushioning ring 23, third cushioning ring 71, supplemental cushioning rings 50, 51, 52, and 53, weight 24, and second weight 70.

As in the preferred embodiment, elongated support rod 30' is a generally cylindrical, elongated, solid, rigid member having threaded apertures 31 and 32 disposed along the central longitudinal axis of elongated support rod 30' at both ends of elongated support rod 30'. Elongated cushioning sleeve 33', preferably constructed of an elastomeric material, such as a visco-elastic polymer, has an inner diameter slightly greater than the outer diameter of elongated support rod 30' and extends coaxially around, and in contact with, the entire outer circumference of elongated support rod 30'. Weight 24 and second weight 70 are identical, preferably rigid, generally cylindrical bodies that extend coaxially around elongated cushioning sleeve 33', and have an inner diameter slightly greater than the outer diameter of elongated cushioning sleeve 33', such that weight 24 and second weight 70 are able to slide along the longitudinal axis of elongated support rod 30'. First cushioning ring 22 is disposed coaxially around elongated support rod 30' and elongated cushioning sleeve 33'. Second cushioning ring 23 is disposed coaxially around elongated support rod 30' and elongated cushioning sleeve 33' between second weight 70 and second end cap 21. Also disposed coaxially around elongated support rod 30' and elongated cushioning sleeve 33', between weight 24 and second weight 70, is third cushioning ring 71. First cushioning ring 22, second cushioning ring 23, and third cushioning ring 71 are generally cylindrical members with the same outer and inner diameters as weight 24 and second weight 70 and preferably are composed of the same elastomeric material as elongated cushioning sleeve 33'.

First end cap 20 and second end cap 21 are identical members, preferably rigid, and preferably with the same outer diameter as first cushioning ring 22, second cushioning ring 23, third cushioning ring 71, weight 24, and second weight 70. First end cap 20 and second end cap 21 are each formed with a threaded aperture, 28 and 29, respectively, along the central longitudinal axis of elongated support rod 30'. First coupler 40 and second coupler 41 also are identical members, preferably rigid, and are each comprised of a smaller diameter threaded stem, 42 and 43, respectively, and a larger diameter threaded stem, 44 and 45 respectively, extending along the central longitudinal axis of elongated support rod 30'. Smaller diameter threaded stems 42 and 43 have a diameter slightly less than the inner diameters of supplemental cushioning rings 50, 51, 52, and 53, first cushioning ring 22, second cushioning ring 23, and third cushioning ring 71 such that supplemental cushioning rings 50, 51, 52, and 53, first cushioning ring 22, and second cushioning ring 23 may slidably mount thereon. Larger diameter threaded stems 44 and 45 each include threaded apertures, 46 and 47, respectively, also extending along the central longitudinal axis of elongated support rod 30'.

When assembled in its operational form, first end cap 20 is threadably mounted to larger diameter threaded stem 44 of first coupler 40. Supplemental cushioning rings 50 and 51, and first cushioning ring 22, are slidably mounted on smaller diameter threaded stem 42 of first coupler 40. Smaller diameter threaded stem 42 of first coupler 40 is threadably mounted to threaded aperture 31 of elongated support rod 30'. As discussed above, elongated support rod 30' is coaxially surrounded by elongated cushioning sleeve 33'. Weight 24 is then slidably mounted on elongated support rod 30' surrounded by elongated cushioning sleeve 33'. Third cushioning ring 71 is then slidably mounted on elongated support rod 30' surrounded by elongated cushioning sleeve 33' followed by second weight 70. Second cushioning ring 23 and supplemental cushioning rings 52 and 53 are then slidably mounted on smaller diameter threaded stem 43 of second coupler 41. Smaller diameter threaded stem 43 of second coupler 41 is then threadably mounted to threaded aperture 32 of elongated support rod 30'. Second end cap 21 is then threadably mounted to larger diameter threaded stem 45 of second coupler 41. Finally, threaded shaft 48 may be threadably mounted in threaded aperture 46 of larger diameter threaded stem 44. Threaded shaft 48 may then be used to removably attach the dynamic stabilizer to a threaded aperture in the forward face of a bow, or to a threaded aperture in a shock dampener or other archery bow accessory. Similarly, threaded aperture 47 of larger diameter threaded stem 45 is adapted to permit the removable attachment of other bow accessories to the stabilizer.

In operation, energy in the form of shocks, vibrations, and torque in a bow that occur during the release of an arrow are transferred through shaft 48 to elastomerically cushioned elongated support rod 30' and weight 24 and second weight 70, where they are converted to heat and dissipated.

Figure 8:
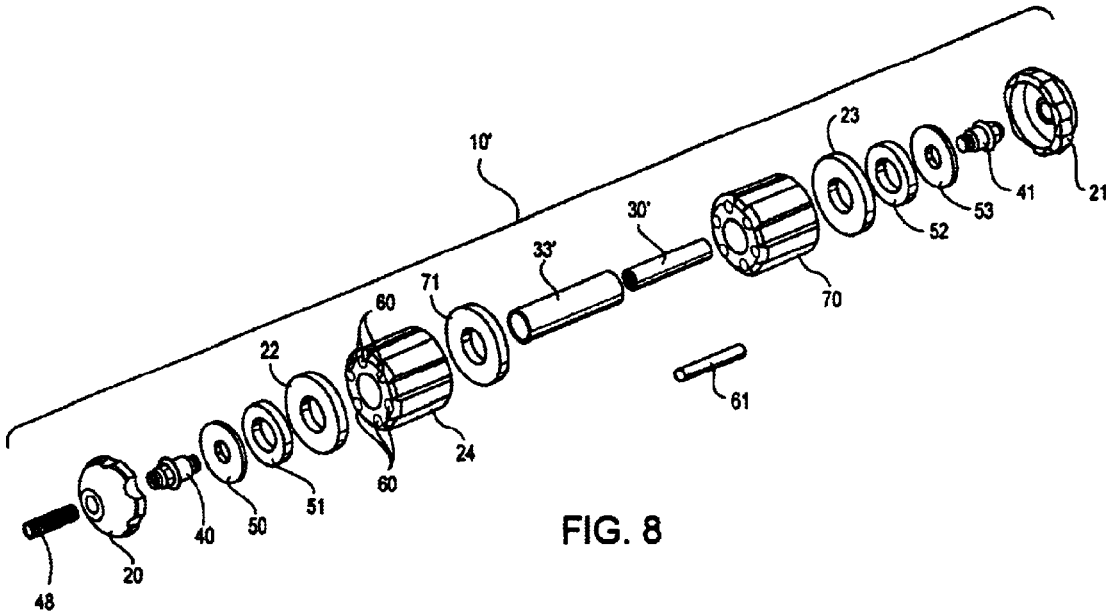
FIG. 8 is an exploded view of an alternate embodiment of the dynamic stabilizer of the present invention with the optional adjustable weight means.

As with the preferred embodiment of the dynamic stabilizer of the present invention, this second embodiment may optionally include a means to variably adjust the weight of weight 24 and second weight 70. As shown in FIG. 8, weight 24 and second weight 70 may be designed with a number of axial bores 60 around their circumferences. Ballast 61 may be inserted into the axial bores 60 to achieve the desired stabilization effect.

While a specific embodiment of the invention has been shown and described, it is to be understood that numerous changes and modifications may be made therein without departing from the scope, spirit, and intent of the invention as set forth in the appended claims.

I claim:

1. A dynamic stabilizer for an archery bow comprising:

at least one elastomerically cushioned weight;

a support rod;

a means to elastomerically cushion said support rod to form an elastomerically cushioned support rod;

a means to slidably mount said at least one elastomerically cushioned weight on said elastomerically cushioned support rod wherein said at least one elastomerically cushioned weight and said elastomerically cushioned support rod absorb shock, vibration and torque created by said archery bow; and a means to removably attach said dynamic stabilizer to said archery bow.

2. The dynamic stabilizer of claim 1 wherein said means to removably attach said dynamic stabilizer to said archery bow comprises a threaded shaft extending from said dynamic stabilizer for connecting to a mating threaded aperture in said archery bow.

3. The dynamic stabilizer of claim 1 further comprising a means to removably attach additional archery bow accessories to said dynamic stabilizer.

4. The dynamic stabilizer of claim 3 wherein said means to removably attach additional archery bow accessories to said dynamic stabilizer comprises a threaded axial bore in said dynamic stabilizer to matingly receive said additional archery bow accessories.

5. The shock dampener of claim 1 further comprising a means to variably adjust the weight of said elastomerically cushioned weight.

6. The shock dampener of claim 5 wherein said means to variably adjust the weight of said at least one elastomerically cushioned weight comprises at least one bore in said at least one elastomerically cushioned weight and at least one weighted ballast to matingly cooperate with said at least one bore in said at least one elastomerically cushioned weight.

7. The dynamic stabilizer of claim 1 wherein said at least one elastomerically cushioned weight and said elastomerically cushioned support rod are elastomerically cushioned by a visco-elastic polymer.

8. A dynamic stabilizer for an archery bow comprising:

a support rod having a first end and a second end;

a plurality of end caps;

an elastomeric cushioning sleeve;

at least one weight; and a plurality of elastomeric cushioning rings;

wherein said plurality of end caps are mounted on said first end and said second end of said support rod, said elastomeric cushioning sleeve is mounted coaxially over said support rod, said weight is mounted coaxially over said elastomeric cushioning sleeve and said support rod, and said plurality of elastomeric cushioning rings are mounted coaxially over said elastomeric cushioning sleeve and said support rod between said at least one weight and said plurality of end caps.

9. The dynamic stabilizer of claim 8 further comprising a means to removably attach said dynamic stabilizer to said archery bow.

10. The dynamic stabilizer of claim 9 wherein said means to removably attach said dynamic stabilizer to said archery bow comprises a threaded shaft extending from said dynamic stabilizer for connecting to a mating threaded aperture in said archery bow.

11. The dynamic stabilizer of claim 8 further comprising a means to removably attach additional archery bow accessories to said dynamic stabilizer.

12. The dynamic stabilizer of claim 11 wherein said means to removably attach additional archery bow accessories to said dynamic stabilizer comprises a threaded axial bore in said dynamic stabilizer to matingly receive said additional archery bow accessories.

13. The dynamic stabilizer of claim 8 further comprising a means to variably adjust the weight of said at least one weight.

14. The dynamic stabilizer of claim 13 wherein said means to variably adjust the weight of said at least comprises at least one bore in said at least one weight and at least one weighted ballast to matingly cooperate with said at least one bore in said at least one weight.

15. The dynamic stabilizer of claim 8 wherein said an elastomeric cushioning sleeve and said plurality of elastomeric cushioning rings are composed of a viscoelastic polymer.

* * * * *